US006045069A

United States Patent [19]

Steed

[11] Patent Number: 6,045,069

[45] Date of Patent: Apr. 4, 2000

[54] ROTARY MILL

[76] Inventor: William G. Steed, c/o 1940 Broadway, Port Coquitlam, British Columbia, Canada, V3C 2N1

[21] Appl. No.: 09/034,617

[22] Filed: Feb. 27, 1998

[51] Int. Cl.[7] ..... B02C 13/08

[52] U.S. Cl. ..... 241/47; 241/73; 241/79.1; 241/189.1

[58] Field of Search ..... 241/47, 79.1, 189.1, 241/73, 285.3, 285.2

[56] References Cited

U.S. PATENT DOCUMENTS

| | | | |
|---|---|---|---|
| 3,887,141 | 6/1975 | Francis | 241/52 |
| 4,033,320 | 7/1977 | Jury | 126/110 R |
| 4,037,796 | 7/1977 | Francis | 241/59 |
| 4,046,325 | 9/1977 | Tucsok et al. | 241/73 |
| 4,146,184 | 3/1979 | Whitney | 241/73 |
| 4,797,004 | 1/1989 | Buschbom | 366/186 |
| 4,861,353 | 8/1989 | Wyss | 55/96 |

*Primary Examiner*—Joseph J. Hail, III
*Assistant Examiner*—William Hong
*Attorney, Agent, or Firm*—Adrian D. Battison; Murray E. Thrift

[57] ABSTRACT

A rotary mill for reduction of ore to particles is described. The rotary mill comprises a primary reduction chamber, a secondary reduction chamber and an outlet chamber. Material entering the primary reduction chamber is deflected by an impact rotor, which shatters the material and sends the resulting particles into a plurality of shatter bars. The shatter bars further reduce these particles and deflect them back towards the rotor so that the reduced particles encounter newly shattered material, causing further attrition. In addition, the rotary mill includes an exhaust fan arranged to generate an airflow from the primary reduction chamber, through the secondary reduction chamber and into the outlet chamber. This airflow carries the reduced particles into the secondary reduction chamber wherein the particles are thrown against reduction means. The reduction means are positioned between the secondary reduction chamber and the outlet chamber such that only particles below a certain size enter the outlet chamber. Material of sufficiently reduced size enters the outlet chamber wherein it is separated into fine particles and heavier particles. Specifically, the heavier particles fall out of the airflow and gather at the base of the outlet chamber until a sufficient weight accumulates to open the balance door which expels the heavy material from the rotary mill.

1 Claim, 1 Drawing Sheet

ROTARY MILL

The present invention relates to an apparatus for ore milling. More specifically, the present invention relates to a rotary mill for impact reduction of ore.

BACKGROUND OF THE INVENTION

One method of removing desirable minerals from waste materials in an ore is to reduce the raw size of the ore. U.S. Pat. No. 3,887,141 teaches a mill for the reduction of ore that uses an impact rotor for obtaining the first reduction. Initially, the material to be reduced in size is introduced into the swept area of the rotor. When the material contacts the rotor, a portion of the accumulated kinetic energy generated by the rotor is transferred to the material, forcing it to accelerate as well as change direction. The material will tend to resist this, so the energy transferred accumulates within the material. This in turn will cause any friable material to shatter along its natural fault lines and the resulting smaller particles will be accelerated away from the rotor. These smaller particles are directed into a series of shatter bars mounted on the walls of the primary reduction chamber, which cause further reductions in the size of the particles upon impact. In theory, airflow from the rotor is supposed to carry sufficiently reduced particles into a secondary reduction chamber wherein they are reduced to fine particles and then collected at a fine particle outlet. However, during operation, material tends to pack in the bottom of the primary reduction chamber, clogging the apparatus. U.S. Pat. No. 4,037,796 teaches a modified version of the ore milling apparatus including a fluidizing rotor located in the base of the primary reduction chamber. This second rotor is supposed to slow the rate at which material settles into the base of the primary reduction chamber by improving the flow of the articles. However, this fluidizing rotor does not compensate for other flaws in the apparatus. Specifically, there is also a tendency for fine particles to collect within the apparatus in areas of low air pressure, as the airflow generated from the rotor is insufficient to carry all of the particles to the outlet. As these particles are naturally quite abrasive, considerable wear will occur in these areas. One area of low pressure, due to its proximity to the outlet, is the secondary reduction chamber. Over time, particles accumulate to such an extent so as to block access to the fine particle outlet. In addition, as weight is the only determining factor in this apparatus as to whether or not the particle passes on to the secondary reduction chamber and the fine particle outlet, the possibility exists that a particle of sufficient size could become lodged in this region of the apparatus. Clearly, this apparatus has the disadvantages of incurring considerable wear during operation and requiring frequent maintenance and cleaning.

SUMMARY OF THE INVENTION

It is one object of the invention, therefore, to provide a rotary mill that overcomes the shortcomings of the prior art.

According to the invention, there is provided an apparatus for fragmenting solid particles comprising:

a housing;

a first impact chamber located within the housing;

an intake chute positioned above the first impact chamber for entry of solid particles;

a rotor having impact means at its periphery located within the first impact chamber, positioned such that said impact means will deflect the solid particles entering through the intake chute, thereby fragmenting the solid particles;

a plurality of shatter bars located within the first impact chamber such that the shatter bars will contact the deflected solid particles, thereby further fragmenting the solid particles;

a second impact chamber located within the housing;

means for connecting the first impact chamber and the second impact chamber;

fine particle outlet means connected to the second impact chamber;

a plurality of reduction means located within the second impact chamber between the first impact chamber and the fine particle outlet means, positioned such that only solid particle fragments below a predetermined size pass through the reduction means and into the fine particle outlet means; and an exhaust fan for generating an airflow through the first impact chamber and the second impact chamber such that the solid particle fragments are blown into the reduction means.

Preferably, the apparatus includes exit means for the solid particles that are too large to exit by the fine particle outlet means and cannot be reduced further.

The exit means for the solid particles may be a balanced door located at the base of the housing.

The fine particle outlet means may comprise a bag housing.

The reduction means may comprise staggered bars, perforated metal lates, wire screens, or combinations thereof.

There are a number of methods in which material may be provided to the above-described apparatus, but the most common and efficient would be by conveyor. In this case, some method of sensing when the apparatus is loaded most efficiently must be provided, due to the fact that the machine cannot be "choke"-loaded. Preferably, computerized control of the conveyor is used to provide a steady input volume regardless of input material size. Rotor shaft RPM and airflow are monitored to indicate loading efficiency and the resulting information is used to control the power source driving the conveyor. In this manner, the mass of material within the apparatus is closely controlled and attrition occurs at a steady rate.

Generally, a rotor with greater exposed blade or hammer surface will move more air, although, as a consequence, this type of rotor is not very durable. However, generation of airflow by the rotor is not a concern in the above-described apparatus because of the supplemental airflow generated by the exhaust fan. As a consequence, the rotor is designed to impart as much accumulated kinetic energy to the incoming material as possible by having the largest mass possible within the swept area of the rotor.

The conveyor is positioned so that material is introduced into the rotor circle in a manner that imparts the maximum amount of the kinetic energy from the revolving rotor to the material with the least amount of strain on the rotor bearings.

The rotor serves only to bump or tip the incoming material and to direct the fractured particles into the shatter bars. The position of the shatter bars is such that, following impact, the particles are directed back toward the rotor swept area and, in a continuous feed situation, these returning particles are met by new particles that have been produced by the rotor striking newly introduced material, thereby causing further attrition. The particles are then swept around the fixed portion of the apparatus connecting the two impact chambers, following a specifically designed curve into the second impact chamber where they are thrown against the reduction means. These are positioned such that only particles of the desired size can pass through and enter the fine particle outlet, while oversized particles are deflected back into the flow of particles, thereby causing yet further attrition. As a consequence, the oversized particles are further reduced in size until they can pass between the reduction means. Thus, the reduction means provide the final particle size control as they form a restrictive path to the fine particle outlet. As stated above, the reduction means may take the form of staggered bars, perforated metal plates, wire screens or all of these combined. Once past the reduction means, the fine particles are drawn off through the outlet while particles with greater weight fall to the outlet door where they accumulate until their weight equals that of the balance weight, at which time the door opens to allow their release. This door is balanced such that several pounds must collect in order for it to open. Once this accumulation has exited, the door closes again.

While the reflection of insufficiently reduced particles into the oncoming flow of material is necessary for further size reduction, a build-up can occur in the second impact chamber and cause clogging or undesirable restriction of material flow as noted in the description of the prior art. This has been overcome by the supplementary airflow generated by the exhaust fan. In this case, the exhaust fan acts as a scavenger by creating a path of steadily moving air from the material intake to the fine particle outlet so that all material follows the desired path through the apparatus. The supplementary airflow also reduces wear, as it prevents entrained particles from contacting the apparatus. Furthermore, the reduction means are staggered or offset so as to force the airflow to rapidly change direction so that any particles with too much mass to remain entrained are reflected back into the flow of material until they have been sufficiently reduced in size to remain in the airflow.

Clearly, the addition of the exhaust fan represents a significant improvement over the prior art. As stated above, the airflow generated reduces wear and prevents build-up of particles throughout the apparatus. As a result, the rotor construction is designed to impart the greatest force on incoming material, as creating airflow with the rotor is no longer a concern. This in turn means that the rotor can be of a more durable design. Furthermore, the reduction means are arranged such that access to the fine particle outlet by oversized particles is restricted, thereby preventing clogs. Lastly, a balanced door is provided for automatically removing oversized particles that accumulate in the base of the apparatus.

DETAILED DESCRIPTION

Figure 1:
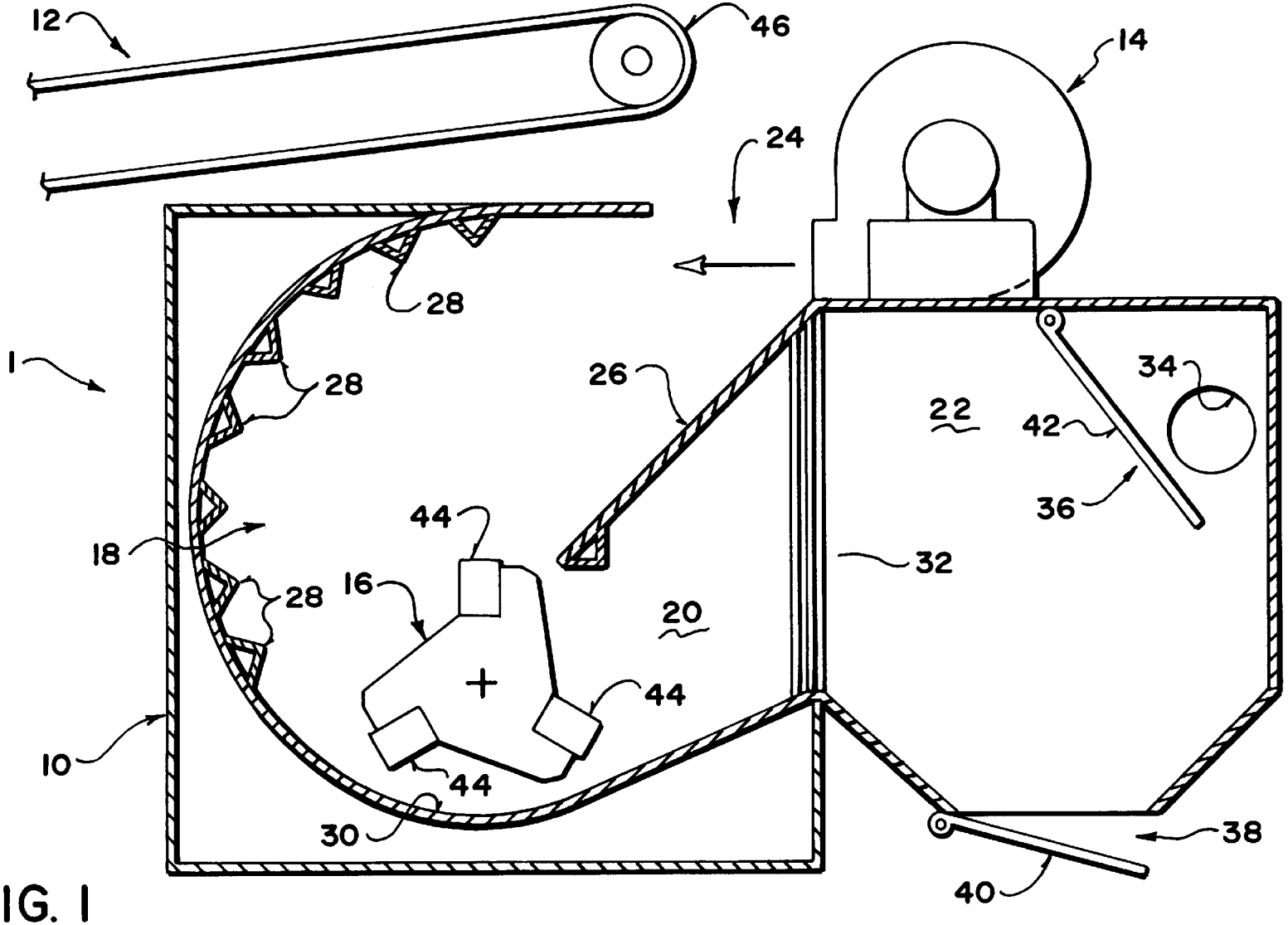
FIG. 1 is a side view in cross-section of the rotary mill.

Referring to the drawing, a rotary mill 1 comprises a housing 10, a material delivery system 12 and an exhaust fan 14. The housing 10 comprises a rotor 16, a primary reduction chamber 18, a secondary reduction chamber 20 and an outlet chamber 22, as shown in FIG. 1.

The primary reduction chamber 18 comprises an inlet opening 24, an intake shaft 26 and a plurality of shatter bars 28. The inlet opening 24 provides access to the interior of the housing 10 for incoming material and for airflow generated by the exhaust fan 14. In this embodiment, the inlet opening 24 is positioned beneath the material delivery system 12. The intake shaft 26 is arranged to direct material from the inlet opening 24 into the swept area of the rotor 16. The plurality of shatter bars 28 are arranged to further reduce particles deflected by the rotor 16 and direct these particles back toward the rotor 16 as described below.

The secondary reduction chamber 20 is connected to the primary reduction chamber 18 by a curved portion 30 as described below. The secondary reduction chamber 18 includes reduction means 32 positioned between the secondary reduction chamber 20 and the outlet chamber 22, arranged such that particles above a given size are prevented from entering the outlet chamber 22. The reduction means 32 may comprise staggered bars, perforated metal plates, wire screens or combinations thereof.

The outlet chamber 22 comprises a fan outlet 34, a fan control means 36 and a lower material outlet 38. The fan outlet 34 comprises the exit from the housing 10 for fine particles and for airflow generated by the exhaust fan 14 as described below. The lower material outlet 38 comprises a balanced door 40 situated at the base of the outlet chamber 22 for removal of heavy particles. Specifically, once a mass of material equal to the balance weight has gathered, the balanced door 40 opens and expels the material from the housing 10. The fan control means 36 comprises a movable baffle 42 located within the output chamber 22 for controlling airflow through the housing 10 so that the amount and size of particles drawn off at the fan outlet 34 and the lower material outlet 38 may be varied as described below.

The rotor 16 is arranged for rotation within the housing 10 and is driven by a motor, the details of which are not shown as these will be obvious to one skilled in the art. The rotor 16 includes peripheral impact means 44 and is situated below the intake shaft 26. While a rotor that exposes more blade will move more air, durable construction and suitable mass for reducing incoming material conflict with ideal air moving capabilities. However, generation of airflow by the rotor 16 is not an important consideration due to the airflow generated by the exhaust fan 14. Thus, the rotor 16 is arranged so that the impact means 44 have the largest mass possible within the swept area of the rotor 16. In this embodiment, the rotor 16 includes three impact means 44, although it is of note that the construction of the rotor 16 may vary greatly.

The exhaust fan 14 is arranged to produce an airflow through the housing. Specifically, the exhaust fan 14 connected to the fan outlet such that the airflow generated by the exhaust fan 14 is drawn into the housing 10 via the inlet opening 24 and is drawn out of the housing 10 via the fan outlet 34. The details of the exhaust fan 14 are not shown as these will be obvious to one skilled in the art.

The material delivery system 12 transports material to the rotary mill 1. In this embodiment, the material delivery system 12 comprises a conveyor 46. For reasons that will become apparent, the rotary mill 1 cannot be "choke" loaded. As a result, computerized control of the conveyor 46 may be used to provide a steady input volume regardless of input material size. Specifically, rotor speed and airflow may be monitored to determine loading efficiency and this information may be used to control the power source driving the conveyor 46. In this manner, the mass of material within the rotary mill 1 may be closely controlled so that attrition of material occurs at a steady rate.

In operation, the material to be reduced is transported by the conveyor 46 to the inlet opening 24. The material passes therethrough onto the intake shaft 26 at a speed at or near free fall. The intake shaft 26 directs the material into the swept area of the impact means 44 of the rotor 16. Of note is that the intake shaft 26 is positioned such that a maximum amount of the kinetic energy generated by the rotor 16 is transferred to the material with minimal strain on the rotor 16, so that the rotor 16 needs only to tip or bump the incoming material. This transfer of kinetic energy shatters the material along natural fault planes, producing smaller particles. The smaller particles are accelerated away from the rotor 16 and into the shatter bars 28 where further reductions occur as a result of collisions between the shatter bars 28 and the smaller particles. Of note is that the shatter bars 28 do not have to be of massive structure or unusual hardness because of the reduced size of the particles. The shatter bars 28 also direct the smaller particles back towards the swept area of the rotor 16 where, in a continuous feed situation, the smaller particles encounter new particles produced by the impact means 44 of the rotor 16 striking newly introduced material and these secondary impacts between reflected material and recently shattered material result in further reduced particles. Of note is that the rotor 16 causes a localized increase in the pressure of the airflow generated by the exhaust fan 14. This forces entrained particles, which are naturally quite abrasive, away from the housing 10, thereby drastically reducing scrubbing and wear on the rotary mill 1. Furthermore, the reduced particles are swept by the airflow drawn through the housing generated by the exhaust fan 14 around the curved portion 30 into the secondary reduction chamber 20.

As noted above, the curved portion 30 is arranged such that the airflow generated by the exhaust fan 14 directs the reduced particles toward the reduction means 32 in the secondary reduction chamber 20. As noted above, the reduction means 32 are arranged such that only particles below a given size, or fine particles, pass through the reduction means 32 and enter the outlet chamber 22 while oversized particles are directed back into the flow of reduced particles leaving the rotor path. Thus, the reduction means 32 provide the final particle size control, forming a restriction in the path that material follows through the housing 10. Furthermore, the close, staggered configuration of the reduction means 32 causes the airflow generated by the exhaust fan 14 to change direction rapidly several times before being drawn out of the secondary reduction chamber 20. This turbulent airflow prevents particle build-up from occurring on the reduction means 32. Of note is that the position and orientation of the reduction means 32 is not critical as they may be placed either vertically or horizontally with little or no change in their effectiveness.

Upon entry into the outlet chamber 22, the fine particles remain in the airflow generated by the exhaust fan 14 and are drawn off through the fan outlet 34 while heavy particles fall to the lower material outlet 38 until a mass accumulates that equals the balance weight, which opens the balanced door 40 and releases the heavy particles. The balanced door 40 ensures that air is drawn into the rotary mill 1 only through the inlet opening 24, thereby keeping a negative pressure on all parts of the housing 10 and serving as a form of dust control. Furthermore, the position of the movable baffle 42 within the outlet chamber 22 may be altered to vary the intensity of the airflow, thereby varying the amount and size of the particles drawn off through the fan outlet 34. In cases where this fine product has value, the flow of fine particles may, for example, be blown into a bag house or cyclone or may be turned into a slurry by the addition of a water spray. Furthermore, the heavy material which exits the lower opening can be fed into any suitable classification machinery for further processing. Thus, this arrangement also serves as a simple means of material classification.

Of note is that the position of the rotor 16 within the housing 10 is quite critical. In this embodiment, a clearance of 0.125 inches is optimum, wherein clearance refers to the ideal spacing between the rotor 16 and the housing 10 as well as the clearance between the impact means 44 and the housing 10. If too much clearance is allowed, turbulence occurs and entrained particles build up which greatly increase the wear on the rotary mill 1.

The importance of having a constant and steady flow of incoming material can be shown when a large particle is introduced and allowed to pass through the rotary mill 1 alone. The resulting pile of reduced material consists of a light scattering of larger particles on the top and bottom of a cross section with the majority in the center finely pulverized, as there are few particles to carry out the attrition process. However, with a constant, regulated flow of input material, there is a steady impingement between fractured particles and the particle size distribution is more even.

Clearly, time of material residency is an important factor in the successful operation of the above-described rotary mill 1. However, the tendency to return particles to the new product flow can cause a buildup of material in the system. This has been overcome by the addition of a supplementary airflow generated by the exhaust fan 14. The exhaust fan 14 creates a path of steadily moving air from the inlet opening 24 to the fan outlet 34. Furthermore, the airflow overcomes turbulence created by the rotor 16 and ensures that all material continues to follow the desired path through the rotary mill 1.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. An apparatus for fragmenting solid materials into particles comprising:

a housing;

a first impact chamber defined within the housing and having a feed opening;

a feed system positioned above the feed opening of the first impact chamber for feed of solid materials into the impact chamber;

a rotor having impact hammers at its periphery located within the first impact chamber for rotation about an axis of the rotor transverse to the feed opening, the rotor being positioned relative to the feed opening such that said impact hammers impact and deflect the solid materials entering through the feed opening, thereby fragmenting the solid materials to form particles;

a plurality of shatter bars located within the first impact chamber arranged such that the shatter bars contact the deflected solid materials, thereby further fragmenting the solid material into said particles;

a second impact chamber defined within the housing downstream of the rotor;

means for connecting the first impact chamber and the second impact chamber such that the particles pass from the first chamber to the second chamber under momentum from the rotor;

the rotor being arranged such that rotation thereof generates an air flow acting to carry the materials from the first impact chamber into the second impact chamber;

an outlet chamber connected to the second impact chamber for receiving the particles therefrom;

a plurality of reduction means located between the second impact chamber and the outlet chamber, positioned such that only particles below a predetermined size pass through the reduction means and into the outlet chamber;

a fine particle outlet duct connected to the outlet chamber and arranged to receive the particles therefrom;

a bottom discharge for allowing release of heavier particles from a bottom of the outlet chamber;

an exhaust fan connected to the fine particle outlet duct for generating an additional airflow through feed opening into the first impact chamber and from the first impact chamber into the second impact chamber;

and a balanced flow control door which normally doses the bottom discharge such that substantially all air exiting the outlet duct passes into the first impact chamber through the feed opening and which is arranged such that it is opened under the weight of the heavier particles to allow said release of the heavier particles through the bottom discharge.

* * * * *